US006354287B1

(12) United States Patent
Kudoh

(10) Patent No.: US 6,354,287 B1
(45) Date of Patent: Mar. 12, 2002

(54) BLOWER UNIT FOR RANGE HOOD AND TEMPORARY FIXING STRUCTURE FOR BLOWER UNIT

(75) Inventor: Hiroshi Kudoh, Kanagawa-ken (JP)

(73) Assignee: Fuji Industrial Co., Ltd., Kanagawa-Ken (JP)

( * ) Notice: Subject to any disclaimer, the term of this patent is extended or adjusted under 35 U.S.C. 154(b) by 0 days.

(21) Appl. No.: 09/409,630

(22) Filed: Oct. 1, 1999

(51) Int. Cl.[7] ..... F24C 15/20

(52) U.S. Cl. ..... 126/299 R; 126/299 D; 248/342

(58) Field of Search ..... 126/299 R, 299 D, 126/299 C; 222/3.92, 3.94; 454/49, 56, 67, 66, 237, 252; 55/467; 220/3.8; 417/360; 248/27.3, 342, 343

(56) References Cited

U.S. PATENT DOCUMENTS

| | | | | |
|---|---|---|---|---|
| 854,046 A | * | 5/1907 | Paugh | 220/3.8 |
| 1,051,942 A | * | 2/1913 | Appleton | 220/3.92 |
| 1,200,958 A | * | 10/1916 | Loftus | 220/3.92 |
| 1,257,375 A | * | 2/1918 | Meacham | 220/3.92 |

(List continued on next page.)

FOREIGN PATENT DOCUMENTS

| | | | | |
|---|---|---|---|---|
| JP | 4-194529 | * | 7/1992 | 126/299 D |
| JP | 4-194533 | * | 7/1992 | 126/299 D |

*Primary Examiner*—Sara Clarke
(74) *Attorney, Agent, or Firm*—Klauber & Jackson

(57) ABSTRACT

There is provided a blower unit for a range hood which is in compliance with the provision of UL Standards in which a connecting work for a power supply cord or the like suspended from a ceiling or the like of a building and an inner cord or the like and a maintenance work for the connected section can be carried out easily from outside. After assembling the blower unit A to the hood, the dividing member 17 becoming a reference level of the top plate 11 adjacent to an inner cord W or the like taken out of the case 1 of the unit member A1 is fixed first before the front panel of the canopy is arranged, a supporter Y for the external cord is fixed to the dividing member 17, the terminal W1' of the external cord W1 supported by the supporter Y and the terminal W' of the inner cord W taken out are bundled (connected) under utilization of the inner space 17*a'* of a space of the dividing member 17, thereafter the dividing member 17 to be fixed later is removably attached to the top plate 11 of the case 1 to constitute the cover 7 and then the connected portions are stored in the storing space.

2 Claims, 14 Drawing Sheets

U.S. PATENT DOCUMENTS 1,534,723 A * 4/1925 Lewis ..... 220/3.94
1,683,742 A * 9/1928 Thomas, Jr. ..... 220/3.94
1,824,548 A * 9/1931 Holmes ..... 220/3.94
1,857,787 A * 5/1932 Meeks et al. ..... 220/3.92
2,528,844 A * 11/1950 Robertson ..... 126/299 D
2,620,127 A * 12/1952 Radcliffe ..... 126/299 R
2,657,626 A * 11/1953 Sonntag ..... 126/299 D
2,828,683 A * 4/1958 Joseph et al. ..... 126/299 D
2,836,114 A * 5/1958 Weaver et al. ..... 126/299 R
2,893,305 A * 7/1959 Jenson et al. ..... 126/299 D
2,912,919 A * 11/1959 Bernstein ..... 126/299 D
2,919,340 A * 12/1959 Jacobs ..... 126/299 R
2,962,955 A * 12/1960 Bernstein ..... 126/299 R
2,971,451 A * 2/1961 Feig ..... 126/299 D
2,993,428 A * 7/1961 Wermager ..... 126/299 D
3,089,479 A * 5/1963 Perl ..... 126/299 R
3,376,804 A 4/1968 Marks ..... 98/115
3,430,799 A * 3/1969 Maier ..... 220/3.8
3,611,909 A 10/1971 Gaylord ..... 98/115 K
3,712,819 A 1/1973 Field ..... 99/400
3,785,778 A * 1/1974 Burstein et al. ..... 126/299 R
3,981,069 A * 9/1976 Johansen ..... 126/299 R
4,011,803 A * 3/1977 Pfaffinger ..... 126/299 R
4,051,322 A * 9/1977 Park et al. ..... 220/3.94
4,083,362 A * 4/1978 Bergmark et al. ..... 126/299 D
4,089,328 A * 5/1978 Bergmark ..... 126/299 D
4,133,300 A * 1/1979 Burton, Jr. et al. ..... 126/299 D
4,141,342 A * 2/1979 Kuechler ..... 126/299 D
4,202,457 A * 5/1980 Tansi ..... 220/3.3
4,286,572 A 9/1981 Searcy et al. ..... 126/299 D
4,350,504 A 9/1982 Diachuk ..... 55/217
4,500,331 A * 2/1985 Cheng ..... 126/299 D
4,617,909 A 10/1986 Molitor ..... 126/299 R
4,620,061 A * 10/1986 Appleton ..... 220/3.8
4,766,881 A 8/1988 Pax ..... 126/299 R
4,784,114 A 11/1988 Muckler et al. ..... 126/299 E
4,856,493 A * 8/1989 Fleming et al. ..... 126/299 R
4,983,799 A 1/1991 Bonnet et al. ..... 219/10.493
5,002,040 A 3/1991 MacFarlane ..... 126/299 D
5,011,033 A * 4/1991 Roth ..... 220/3.94
5,191,171 A * 3/1993 Bordwell ..... 220/3.8
5,311,857 A * 5/1994 Chang ..... 126/299 R
5,360,130 A * 11/1994 Lehmann et al. ..... 220/3.8
5,448,987 A * 9/1995 Jang ..... 126/299 R
5,594,205 A * 1/1997 Cancellieri et al. ..... 220/3.2
5,594,208 A * 1/1997 Cancellieri et al. ..... 220/3.92
5,690,093 A 11/1997 Schrank et al. ..... 126/299 D
5,703,327 A * 12/1997 Jorgensen ..... 220/3.92
5,775,319 A * 7/1998 Pettinari ..... 126/299 R

* cited by examiner

BLOWER UNIT FOR RANGE HOOD AND TEMPORARY FIXING STRUCTURE FOR BLOWER UNIT

BACKGROUND OF THE INVENTION

1. Field of the Invention

This invention relates a blower unit for a range hood and a temporary fixing structure of the blower unit against the hood.

2. Description of the Related Art

There is already provided a range hood of a type in which a hood is laterally bridged between wall cabinets and the front surface of the hood is provided with a front panel of a canopy.

In this type of range hood, the blower unit is fixed to the hood, wherein oily smoke generated during cooking is absorbed by a gas discharging device within the blower unit and the smoke is discharged out of the gas discharging duct connected to the gas discharging duct coupler.

Even in this type of range hood, a person must observe UL (Underwriters Laboratories) Standards.

In this UL Standards, there is a provision saying that a connected portion between an external power supply cord suspended from a ceiling of a building and an inner cord must be capable of being acknowledged while a separate member differing from the case (body) of the blower unit is removed and no tension is applied.

The prior art product was made such that a conduit pipe suspended from a ceiling or the like of a building was connected to a case (body) of the blower unit and the power supply cord in the conduit pipe and the inner cord were bundled (connected).

In such a structure as described above, when the connected portions are to be inspected, the front panel is at first removed from the lower side, and various kinds of composing members of the higher level are required to be removed in sequence, resulting in that the maintenance work becomes quite troublesome.

Even in this type of range hood, it is a general fixing structure in which the unit is freely fitted from lower side to the fixing port opened at the hood and the blower unit is assembled under this state.

However, there is provided a practical situation in which the blower unit is made such that various kinds of members such as a gas discharging fan, its fan motor and a fan casing are assembled in the case and its weight is quite heavy (8 kg to 10 kg).

Due to this fact, when the blower unit was assembled, it became an essential requirement that the blower unit itself is supported from below with one person and other several workers perform a screw fixing against the hood, resulting in that it required a large-scaled work as well as several workers and so this was not preferable in view of a labor cost.

This invention has been invented in reference to the aforesaid circumstances of the prior art and it is an object of the present invention to provide a blower unit for a range hood which is in compliance with the provision of UL Standards and in which a work for connection between a power supply cord suspended from a ceiling of a building and an inner cord and a maintenance work for the connected portion can be performed easily from outside.

It is another object of the present invention to provide a temporary fixing structure for a blower unit in which an assembling workability of the blower unit to the hood is improved.

As a technical means applied for solving the above objects, the gist of the blower unit consists in a blower unit for a range hood which is freely fitted to a fixing port opened at a hood and having a gas discharging multi-vane fan and a fan motor or the like stored therein, wherein inner cords are taken out externally of a taking-out port opened at a top plate of a case of a unit member having the multi-vane fan and the fan motor or the like stored therein, a cover fixing in a communicated manner the lower end of a supporter for the external cords is arranged at the upper surface of the top plate of the case, the cover is constituted by a plurality of decomposable divided members removably attached to the upper surface of the top plate of the case and said cover has at its inner side a storing space for a connected portion between said inner cords and external cords.

In view of the foregoing, it is also apparent that the plurality of divided members can be divided into two or several segments.

In addition, the outer cord supporter is a conduit (a power supply cord or an earth cord is wired in the conduit) suspended from a ceiling or a side wall of a building or an integral wire in which either the power supply cord or the earth cord is coated by an insulating film, their extremity ends are of threaded cylinders, they are inserted into the connected holes opened at the required divided member or fixing recesses and they are fixed with nut from inside.

According to the aforesaid technical means, the divided member becoming a top plate level reference near the inner cord taken out of the case of the unit member is fixed at first after the blower unit is assembled to the hood and before the front panel of the canopy is arranged and then the outer cord supporter is fixed to the divided member.

Then, after the terminal of the outer cord or the like supported by the supporter and the terminal of the inner cord taken out are bundled (connected) under utilization of a connecting space of the inner space of the divided member, the divided member to be fixed later is removably attached to the top plate of the case to constitute the cover and then the connected portion is stored in the storing space.

In the case of the conduit pipe, the outer cord or the like and the inner cord or the like are drawn out of the divided member fixed at first under utilization of a degree of freedom of taking-out and it can be bundled (connected) to the inner cord under a utilization of an open space. With such an arrangement as above, the wire bundling work (wire connecting operation) becomes more easy.

In addition, second aspect of the present invention has a gist according to first aspect of the present invention, wherein said unit member has a volute plate assembled around the multi-vane fan, a partition plate having a suction port in correspondence with the multi-vane fan is fixed in an inner fixed manner from a lower releasing section of the case to enclose and form a fan casing.

According to the aforesaid technical means, the fan casing is constituted by the volute plate assembled around the multi-vane fan, the partition plate arranged at a front side (lower side) of the volute plate and the case, and then a heavy weight and a large-sized device of a type in which the fan casing is separately stored in it are avoided.

The fixing structure for the blower has a gist in a blower unit for a range hood according to first or second aspect of the present invention, wherein an inverse L-shaped piece is inserted into each of opposing side plates of said case of the unit member having a multi-vane fan and a fan motor or the like under a state of which horizontal section is protruded outwardly in such a manner that it can be turned half, said horizontal section is turned half outside in a vertical direction when the unit member is freely fitted to said fixing port from below so as not to prohibit its free fitting, after the free fitting, it is turned half in an inverse direction and the horizontal section is mounted on the upper surface of said hood.

In view of the foregoing, the side plate where the inverse L-shaped piece is inserted in such a manner that it may be turned half is defined as a lower level of the partition plate.

In addition, the inverse L-shaped piece is freely set such that a plurality of horizontal sections spaced apart from the vertical section are extended in a right angle or the horizontal sections are extended at a right angle with an equal length to the vertical section. In this case, it is satisfactory that the insertion holes are opened at the side plate of the case corresponding to the horizontal section.

According to the aforesaid technical means, when the unit member having the multi-vane fan and the fan motor or the like is freely fitted from below to the fixing port of the hood, the horizontal section of the inverse L-shaped piece is turned half in a vertical direction so as not to become an obstacle against its free fitting, and the horizontal section is turned half in a reverse direction when the horizontal section reaches the rear side of the hood, the horizontal section is mounted on the upper surface of the top plate of the hood at the edge of the fixing port to perform a temporary fixing so as to prevent the heavy unit member from being dropped.

After this operation, the unit member is fixed to the top plate of the hood and lastly the front panel having a grease filter and an operating section or the like is fixed to complete the assembling work for the blower unit.

In addition, the inverse L-shaped piece according to third aspect of the present invention is further preferable if the horizontal section is light in respect to the vertical section.

According to the aforesaid technical means, when the hood is freely fitted to the fixing port, the horizontal section of the inverse L-shaped piece is abutted against the edge of the fixing port, turned half automatically in a vertical direction not to prevent any free fitting of it and after free fitting, the horizontal section is returned back to its horizontal state while being turned automatically in a reverse direction due to the weight of the vertical section. Thus, the inverse L-shaped piece is not intentionally turned, but the heavy unit member is temporarily fixed.

(b) indicates a state in which the horizontal section is just turned half in its stroke;;

(c) indicates a state in which the horizontal section is mounted on an upper surface of a top plate of a hood and temporarily fixed to it; and (d) indicates a state in which the unit member kept at its temporary fixed state is lifted up slightly and fixed with a screw to the top plate of the hood.

Figure 9:
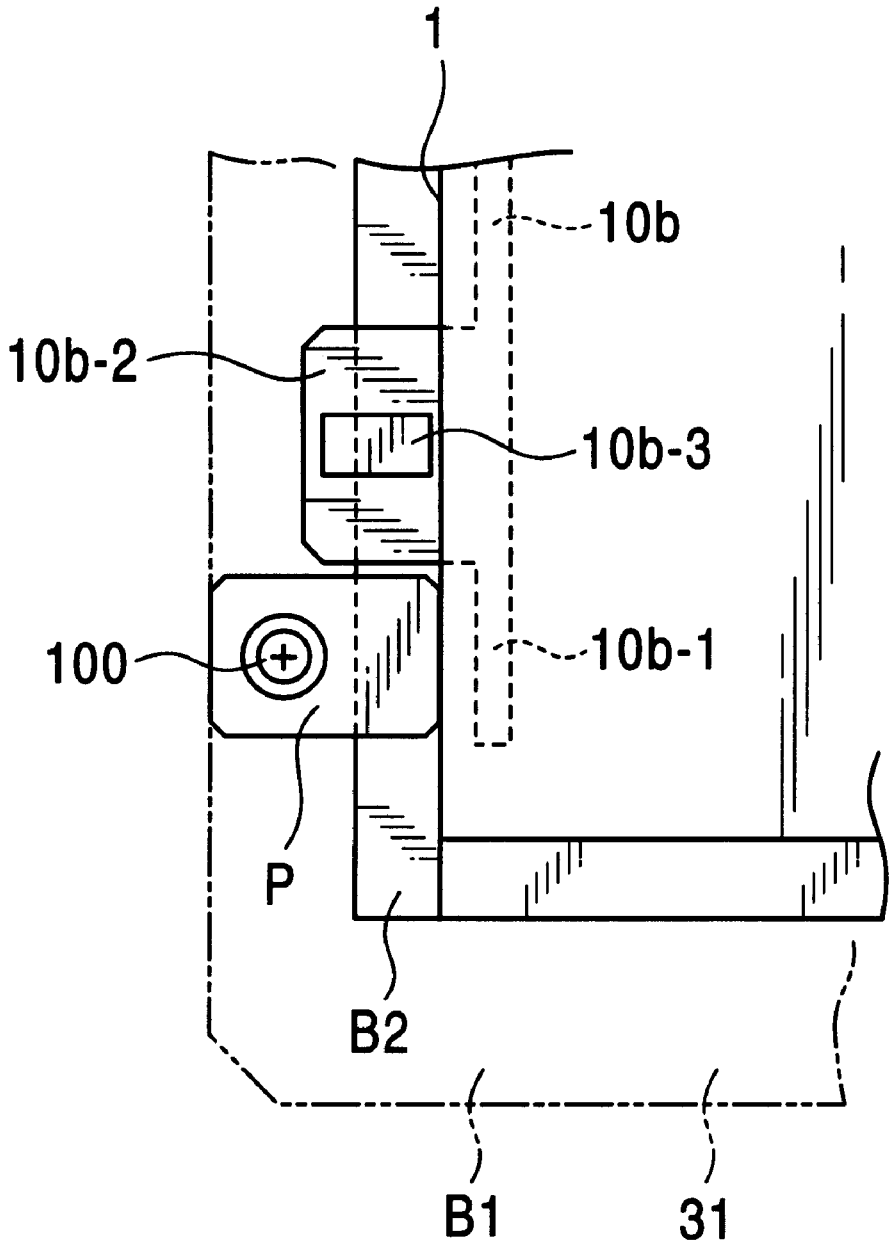

FIG. 9 is an enlarged top plan view of FIG. 8(*d*).

Figure 10:
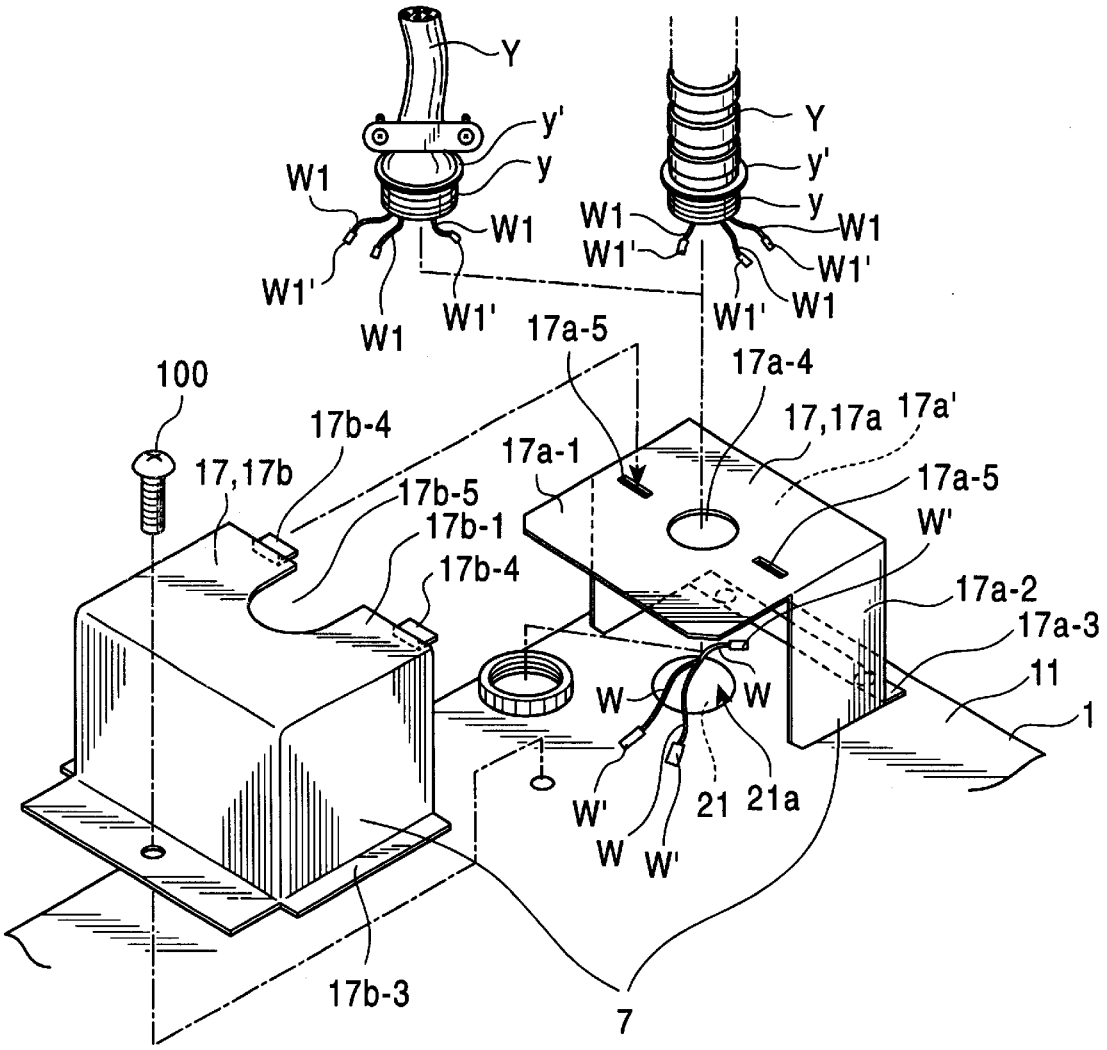

FIG. 10 is an exploded perspective view of a cover.

Figure 11:
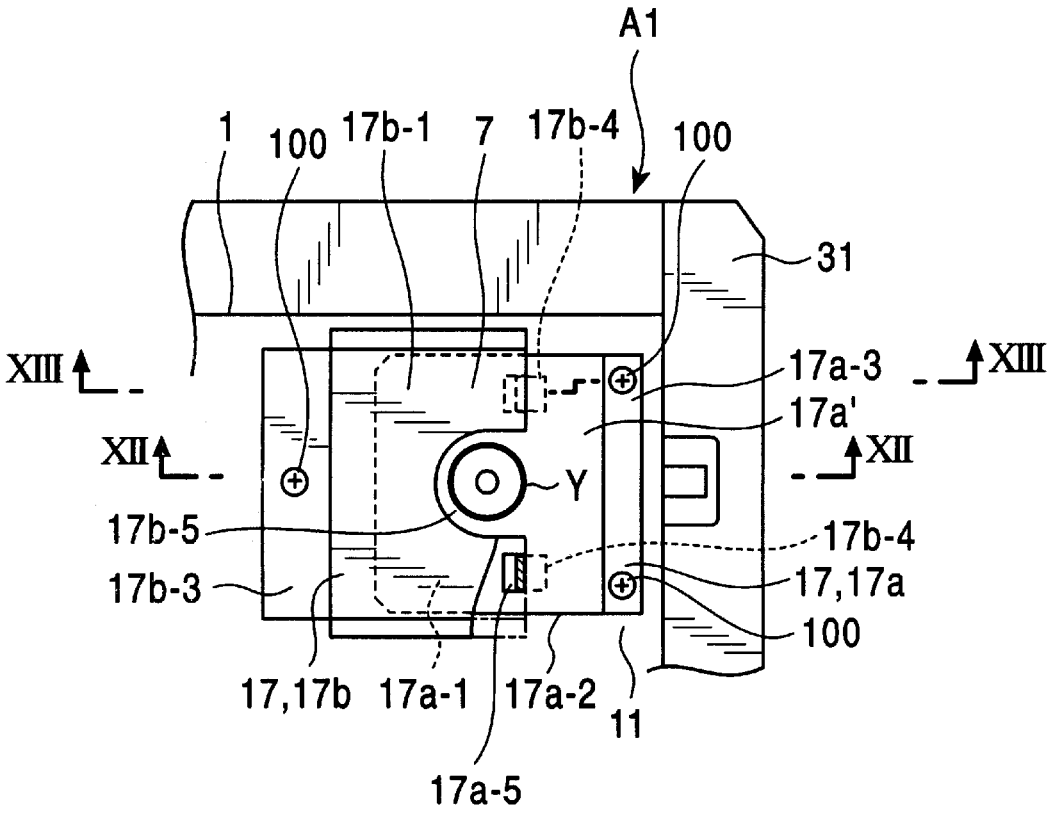

FIG. 11 is an enlarged top plan view for showing a cover being assembled.

Figure 12:
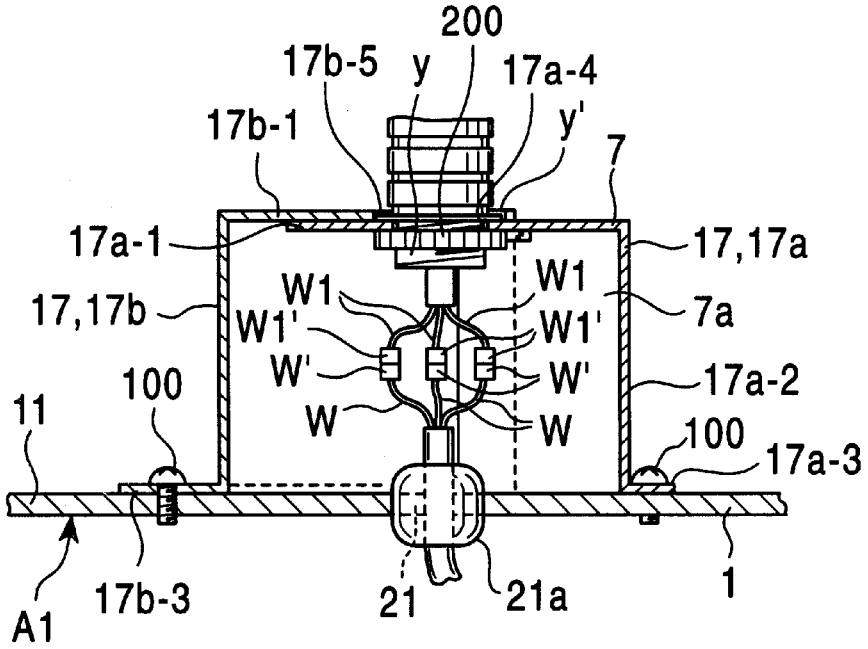

FIG. 12 is a sectional view taken along a line (A)—(A) of FIG. 11.

Figure 13:
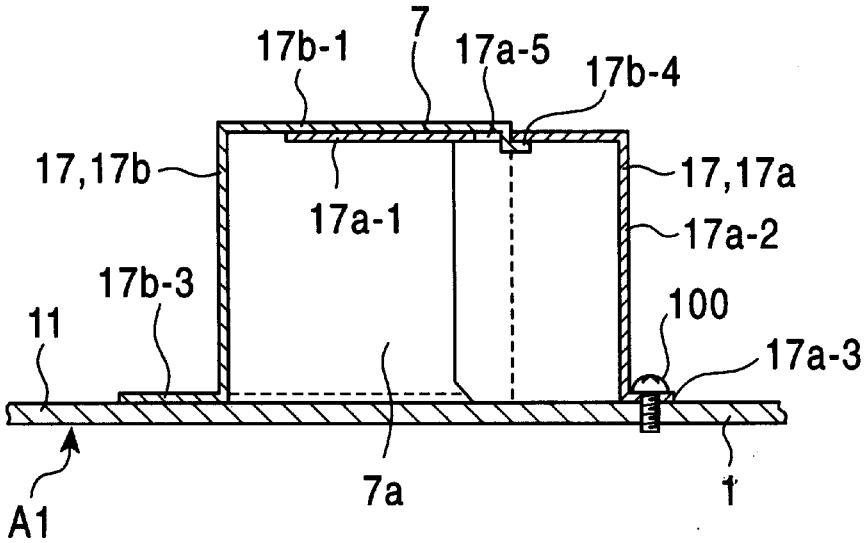

FIG. 13 is a sectional view taken along a line (B)—(B) of FIG. 11.

Figure 14:
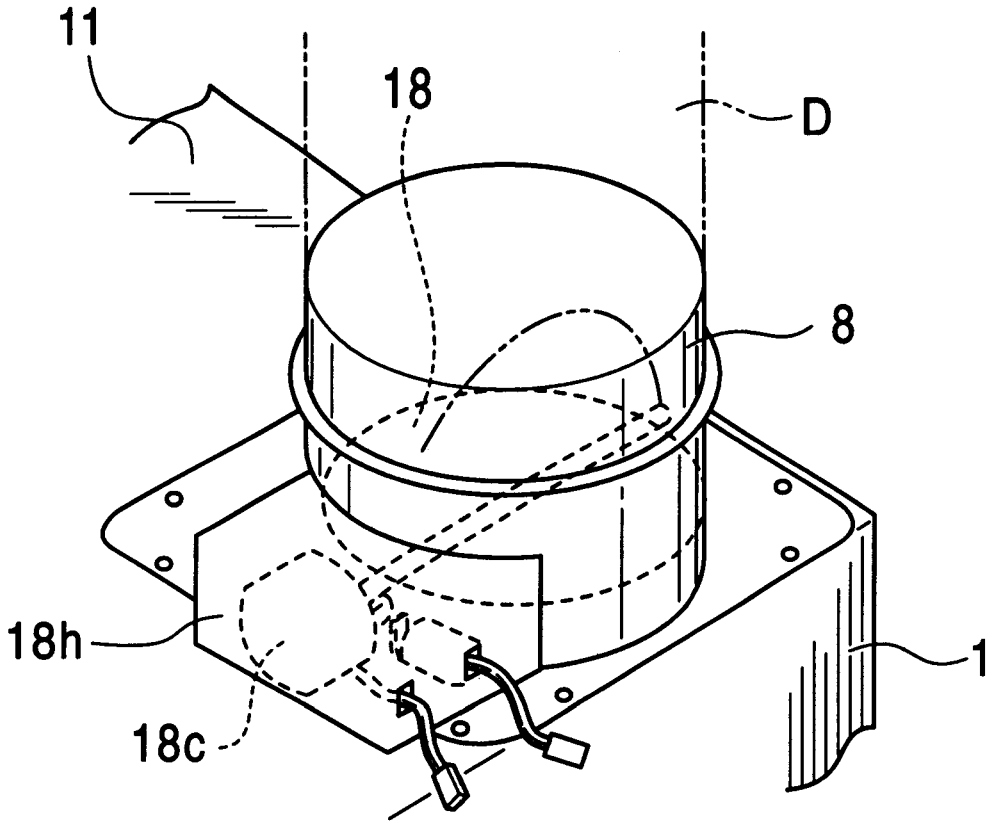

FIG. 14 is an enlarged perspective view for showing a discharged gas duct coupler portion having an electric shutter.

Figure 15:
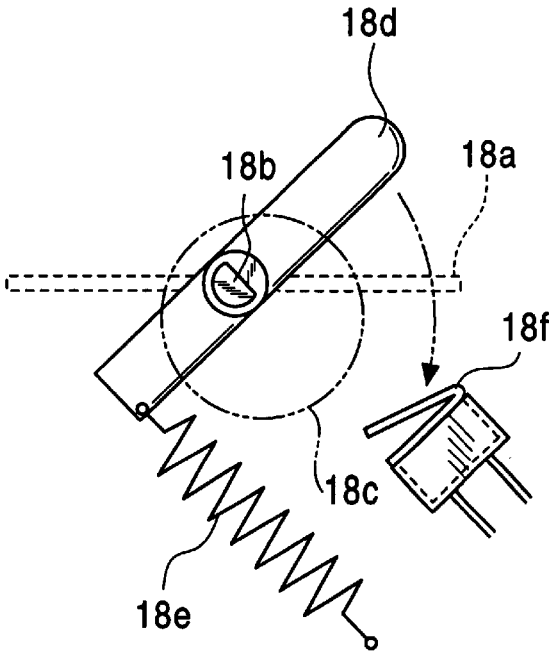

FIG. 15 shows a relation of an arm, a limit switch and a tension spring under a state in which a shutter plate of the electric shutter closes an inner side of a discharging gas duct coupler.

Figure 16:
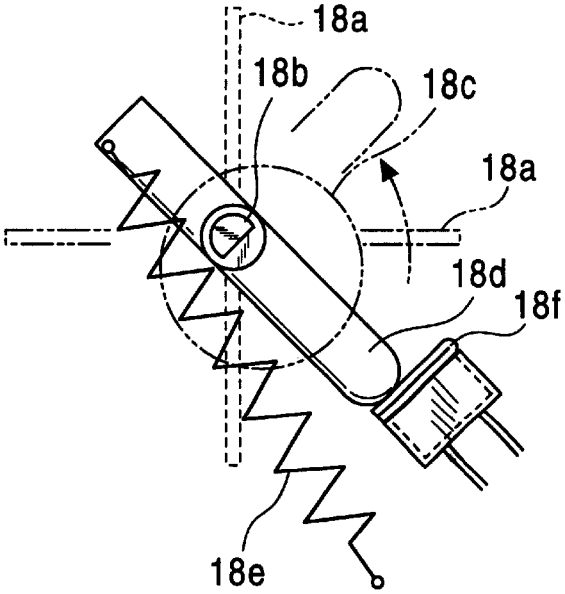

FIG. 16 shows a relation of an arm, a limit switch and a tension spring under a state in which a shutter plate of the electric shutter is turned reversely by 90° to enable a gas discharging to be carried out.

DESCRIPTION OF THE PREFERRED EMBODIMENT

Then, referring now to the drawings, one preferred embodiment of the present invention will be described as follows.

FIGS. 1 to 16 illustrate a preferred embodiment of a blower unit for a range hood of the present invention and a temporary fixing structure for the blower unit, wherein reference numeral A denotes a blower unit.

Figure 1:
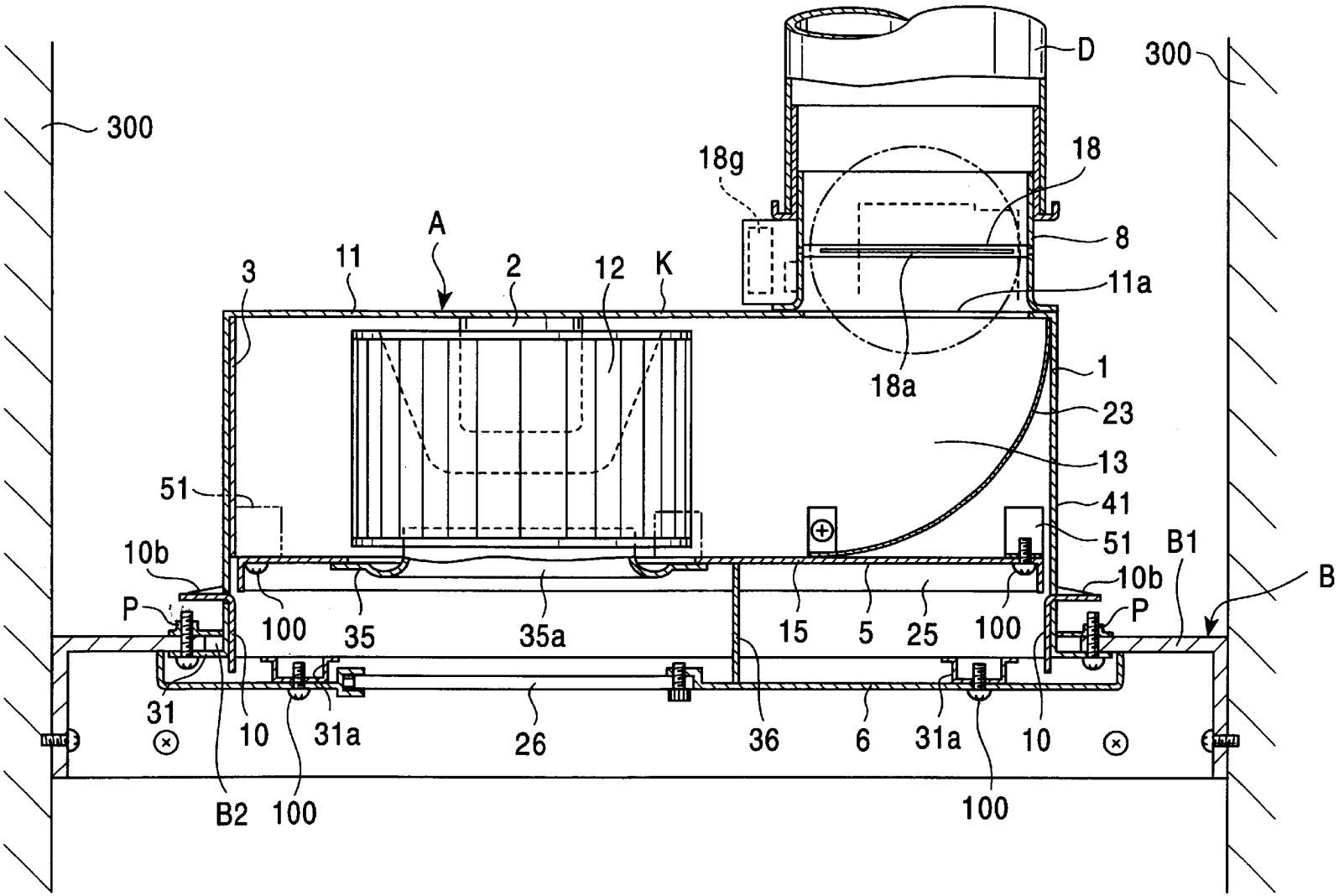
FIG. 1 is a front sectional view for showing a fixed state of a blower unit to a hood.
Figure 2:
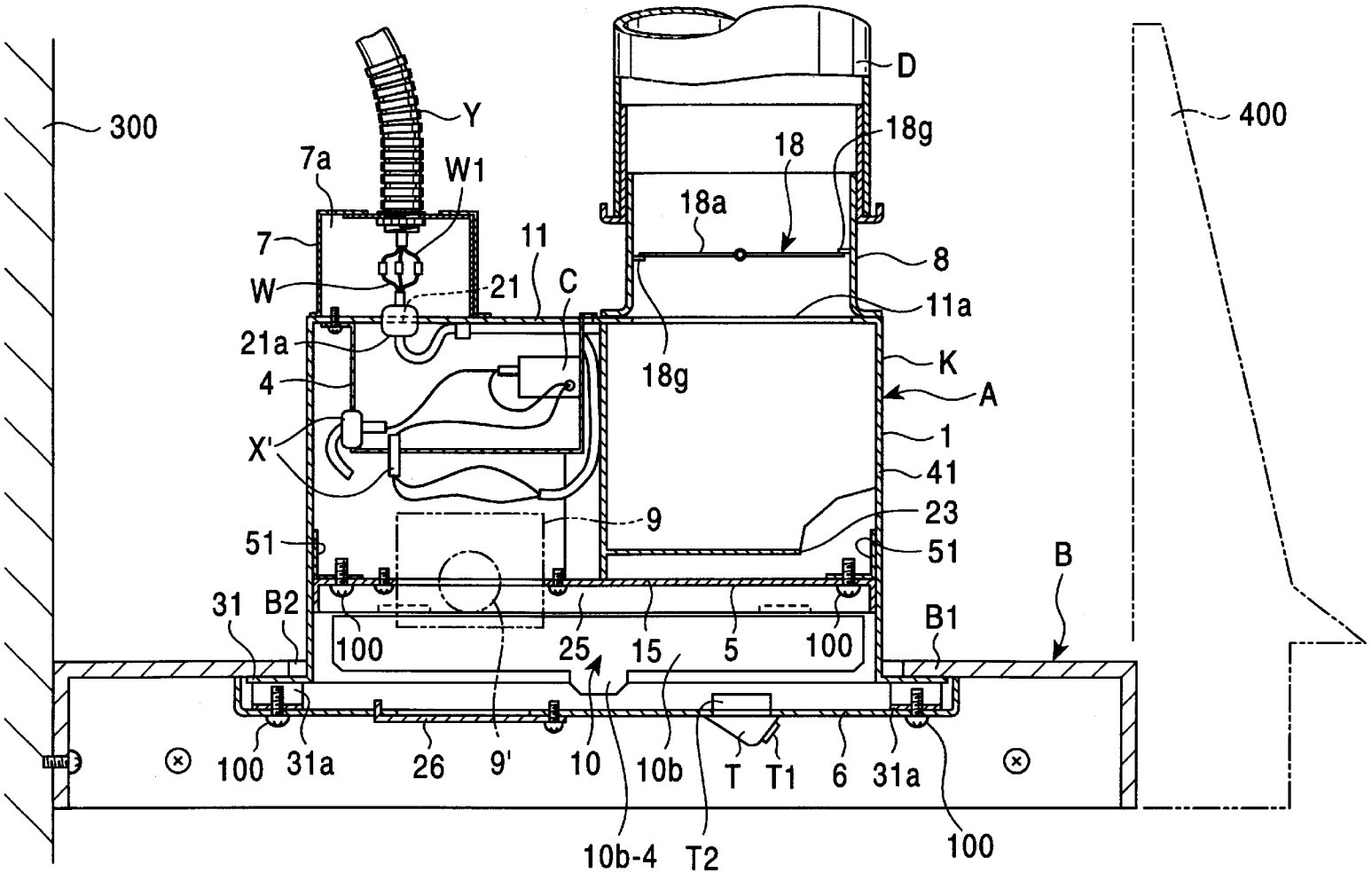
FIG. 2 is a side sectional view of FIG. 1.
Figure 3:
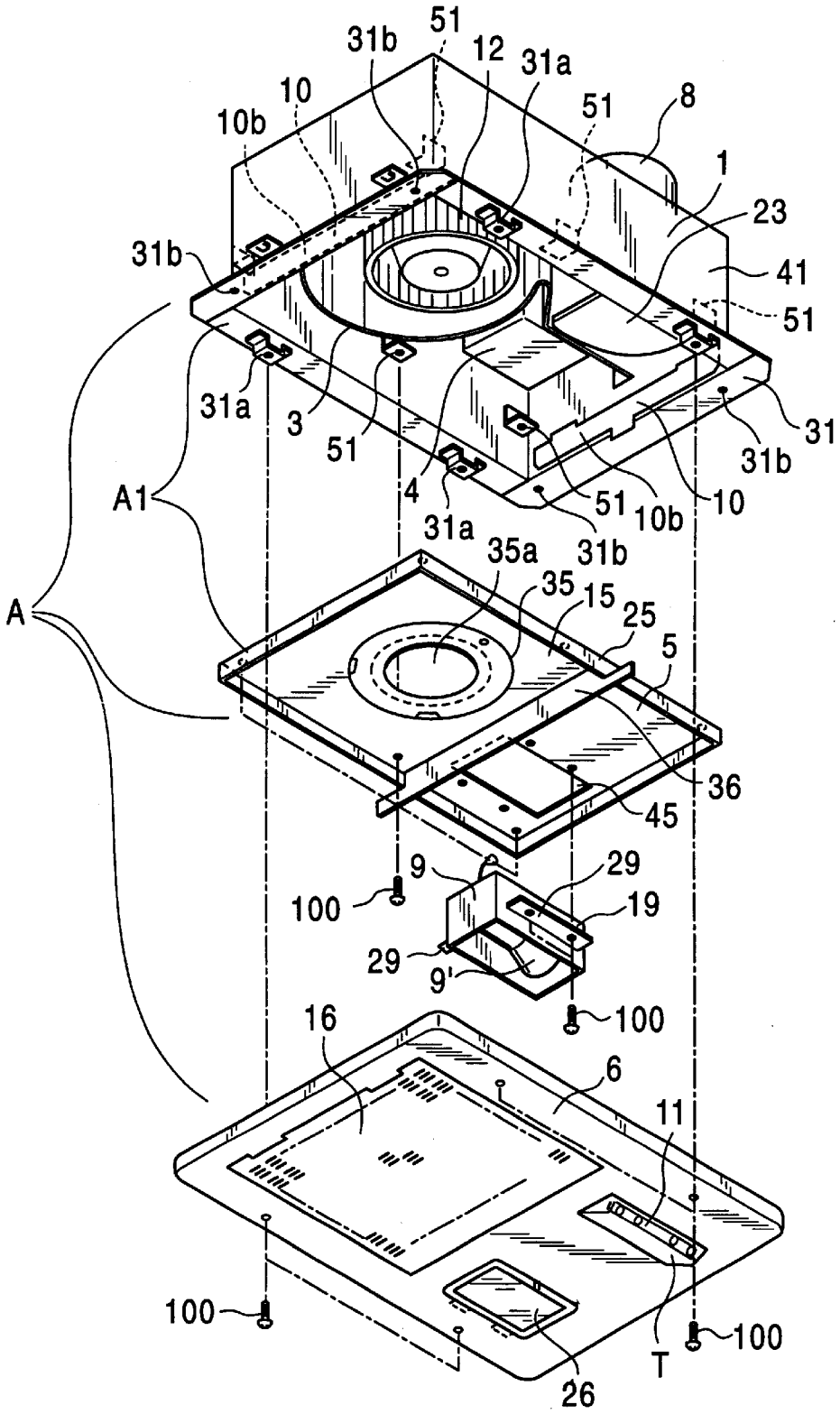
FIG. 3 is an exploded perspective view for showing a blower unit.
Figure 4:
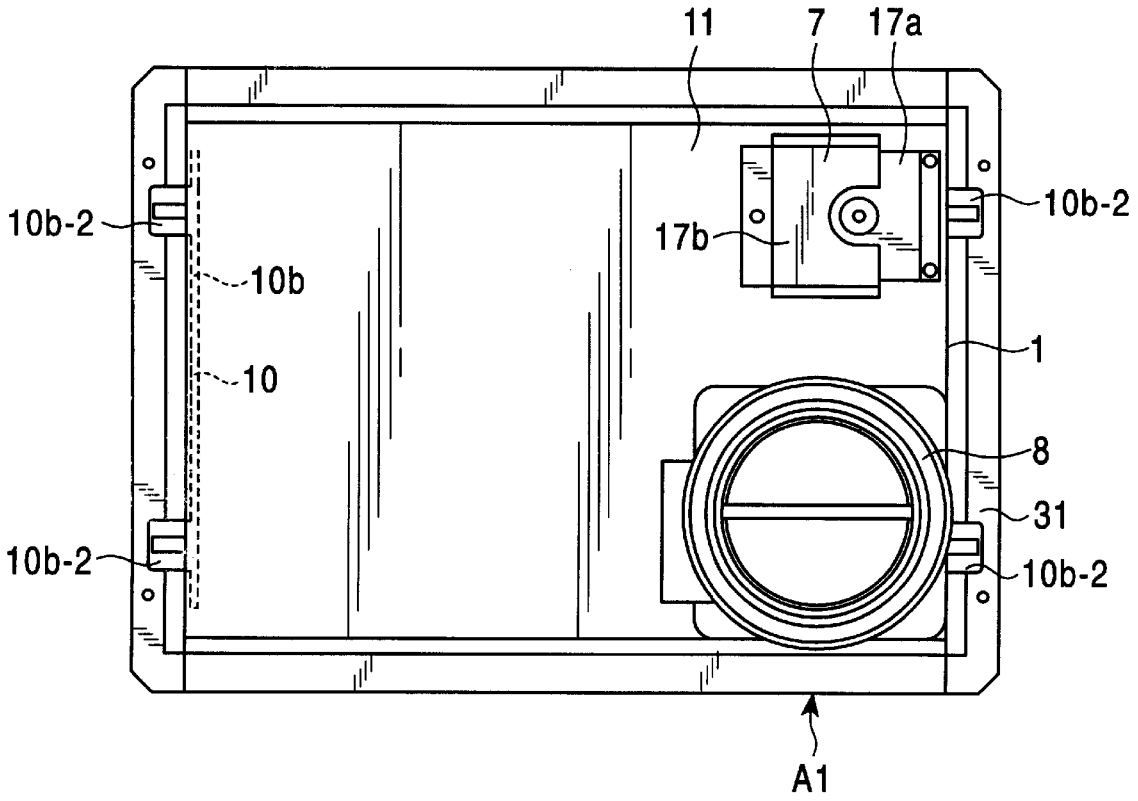
FIG. 4 is a top plan view for showing a unit member.
Figure 5:
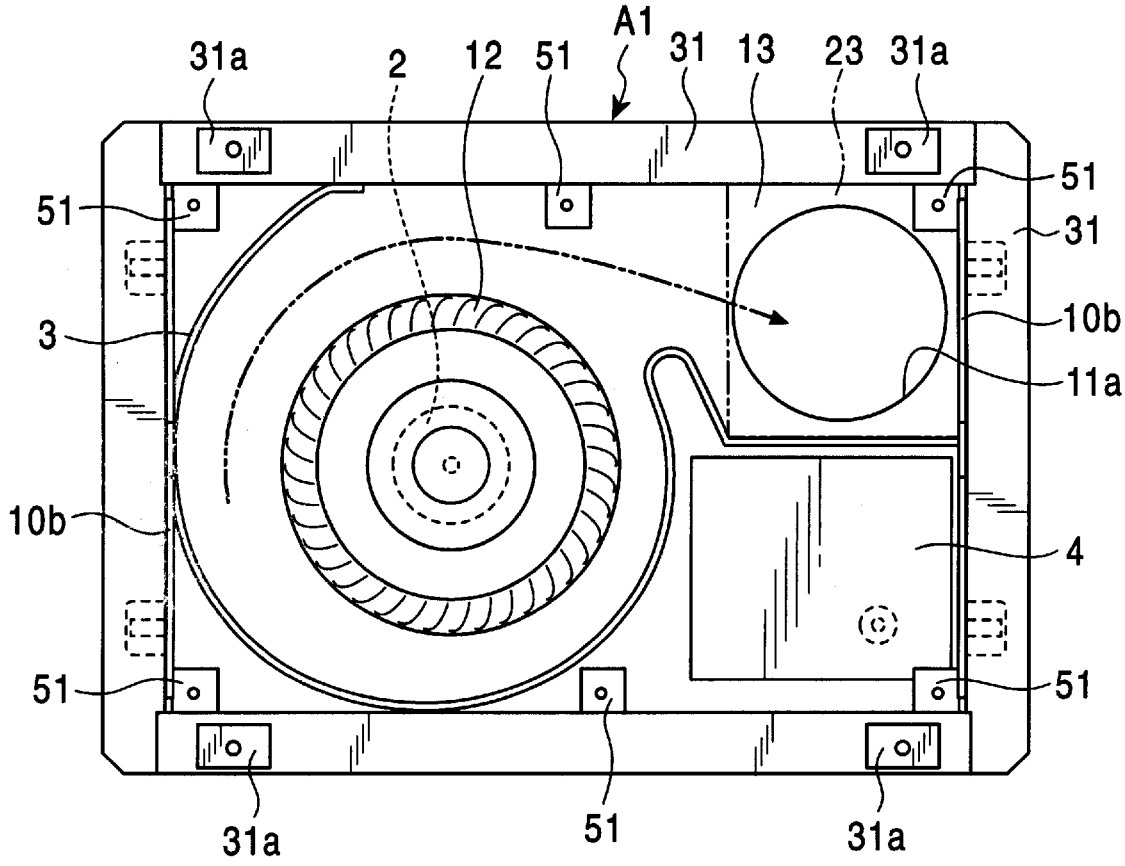
FIG. 5 is a bottom view for showing the unit member with a partition plate and a guide plate being eliminated.
Figure 6:
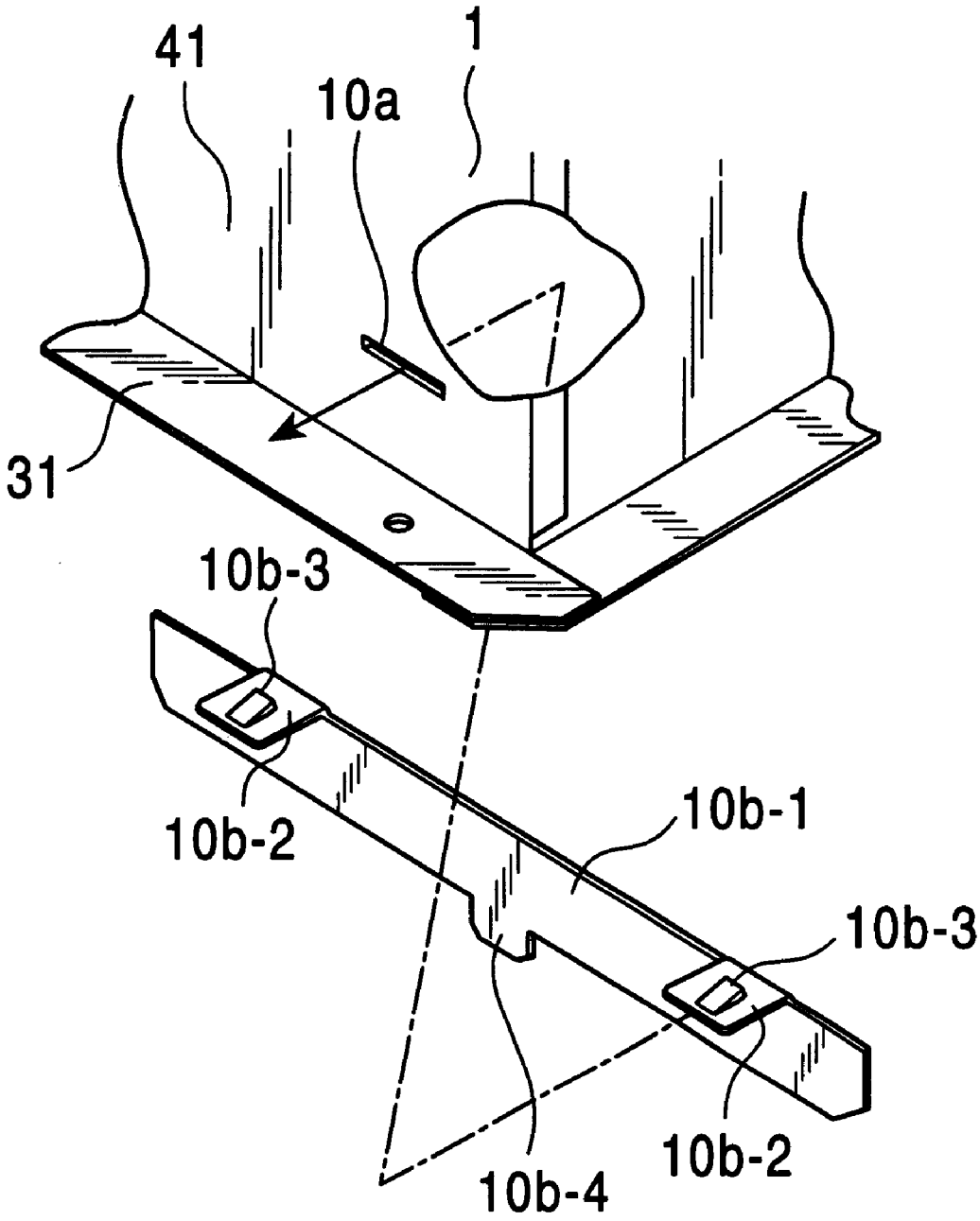
FIG. 6 is a partial perspective view with a part being broken away to show a state in which an inverse L-shaped piece is being inserted into a case of the unit member.

As shown in FIGS. 1 to 3, this blower unit A is comprised of a case (body) 1; a fan motor 2 and a multi-vane fan 12 fixed to the case 1; a volute plate 3 fixed around the multi-vane fan 12; an electrical wiring box 4 arranged within the case 1 not occupied (not enclosed) by the volute plate 3; a partition plate 5 fixed within the case 1 at a lower level of the multi-vane fan 12; a front panel 6 covering a lower releasing section of the case 1 at the lower level of the partition plate 5; and a cover 7 fixed on a top plate 11 in such a manner that the extremity ends of inner cord W or the like (a power supply cord, an earth cord or the like) within the electrical wiring box 4 taken out to the surrounding section from a taking-out port 21 opened at the top plate 11 of the case 1.

Figure 7:
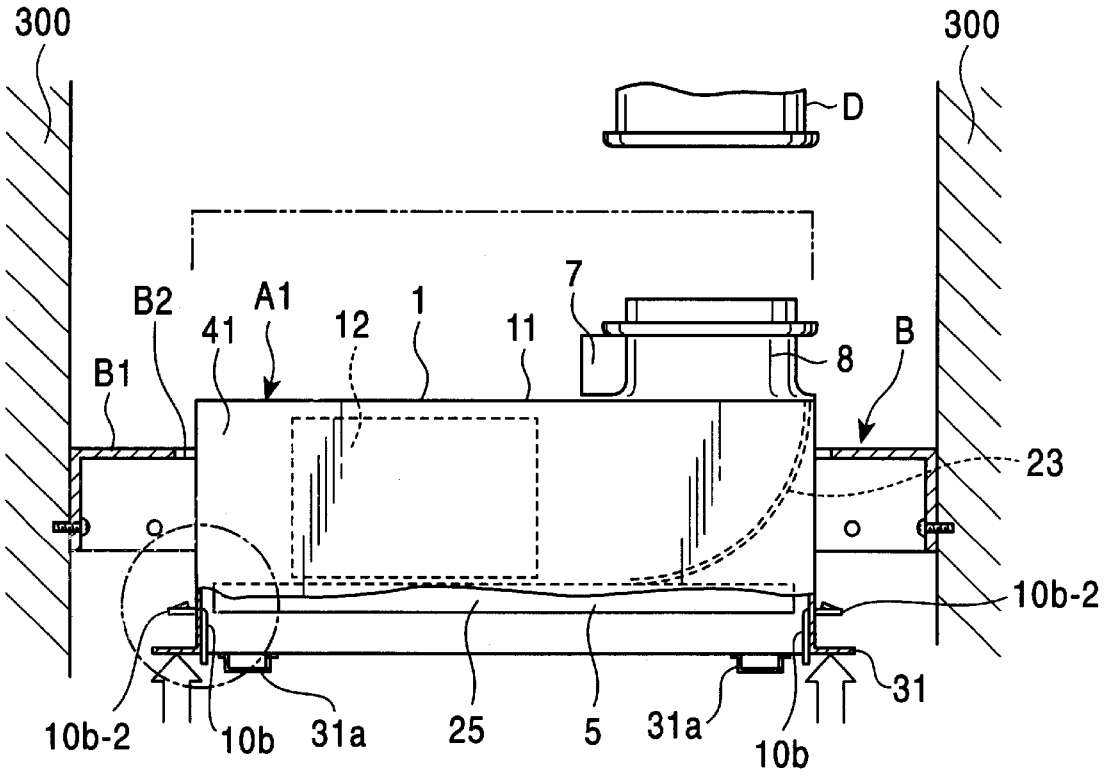
FIG. 7 is a front elevational view with a part being broken away to show a temporary fixed state of the unit member.
Figure 8A:
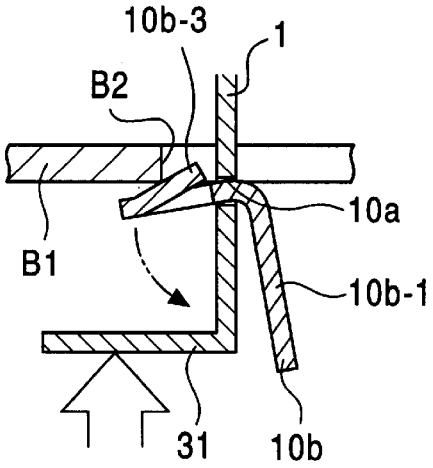
FIGS. 8(*a*), (*b*), (*c*) and (*d*) are enlarged sectional views for showing a substantial part in its temporary fixed state, wherein (a) indicates a state in which the unit member is lifted up, a horizontal section of the inverse L-shaped piece is abutted against an edge part of a fixing port and turned in a downward direction.
Figure 8B:
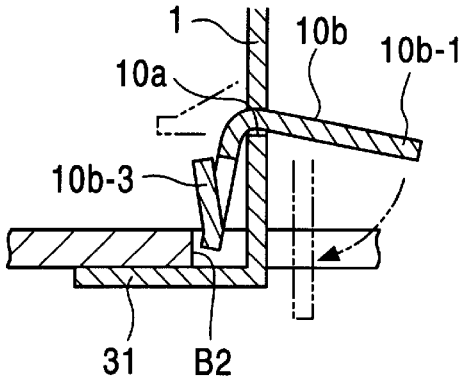
Figure 8C:
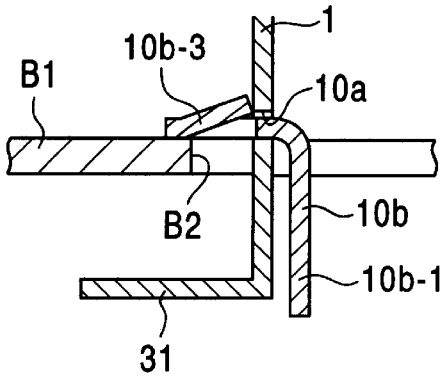
Figure 8D:
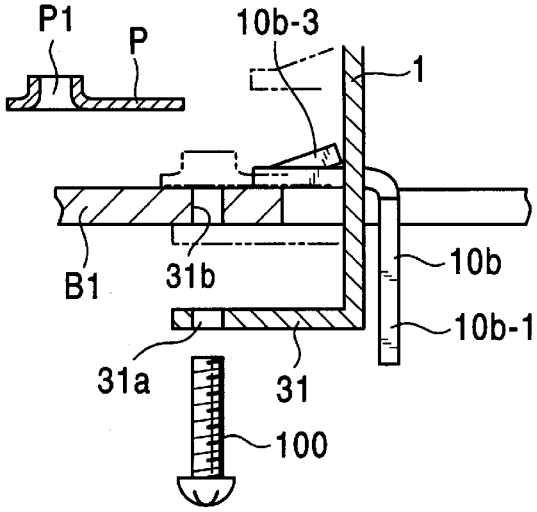

The case 1 forms a rectangular box shape having an outward flange 31 at its lower releasing side, wherein each of various kinds of facilities, such as the fan motor 2, the multi-vane fan 12 driven and rotated with the fan motor 2 being applied as a driving source, the volute plate 3, the electrical wiring box 4, the cover 7 on the top plate 11 of the case and the partition plate 5 and the like is assembled to constitute a unit member A1 (refer to FIG. 7).

In addition, the unit member A1 is constituted such that the fan motor 2 is fixed to the top plate 11, the multi-vane fan 12 is pivotally attached to the driving shaft in a horizontal manner, the volute plate 3 is fixed around the multi-vane fan 12, a curved guiding plate 23 for guiding discharged gas in a direction toward the top plate 11 of the case is fixed to the part of a discharging passage 13 at the terminal end of the volute plate 3 and ascending oil smoke rising from the cooking equipment from a discharging port 11*a* opened at the top plate 11 of the case via a discharging duct coupler 8 is discharged out of a discharging duct D, wherein fixing seats 51 for the partition plate 5 are fixed to the inner surface near the lower level of the case side plate 41 (see FIGS. 1, 2, 3 and 5).

As shown in FIGS. 2 and 3, the electrical wiring box 4 is removably attached to the part in the case 1 avoiding the discharging passage 13 and then a capacitor C and the like are stored in the electrical wiring box 4.

As shown in FIG. 3, the partition plate 5 is comprised of a main body plate 15 having such an area as one covering a releasing section of the case 1 and guiding flange sections 25 bent from the circumferential edge of the main body plate 15 in a downward direction, wherein the main body plate 15 is provided with a bell mouth 35 forming a suction port 35*a* in correspondence with the multi-vane fan 12, an installing port 45 for a lamp box 9 is opened at a portion opposing against the electrical wiring box 4, it is fixed to the fixing seat 51 with screws 100 so as to constitute a fan casing K within the unit member A1 with the volute plate 3 and the case 1.

The lamp box 9 is fixed to the partition plate 5 as shown in FIG. 3 in such a manner that fixing pieces 29 are protruded at a pair of opposing side high level locations of the box member 19 forming a rectangular box, the box member 19 is fitted to the installing port 45, thereafter the fixing pieces 29 are fixed to the main body plate 15 around the installing port 45 with screws 100.

As shown in FIGS. 2 and 12, the inner cord W and the like wired in the electrical wiring box 4 pass through a rubber bushing 21*a* installed at a taking-out port 21 opened at the top plate 11 of the case, a terminal (connecter) W' at the extremity end side is positioned above the upper surface of the top plate 11 of the case and then it is stored in the cover 7 assembled at the upper surface of the top plate 11 of the case in such a way that it may be disassembled.

In FIG. 2, reference numeral X' denotes a rubber bushing for use in guiding a terminal (connector) for wiring to the fan motor 2, the control part (not shown) and the lamp 9' or the wiring and this bushing is assembled to the box wall of the electrical wiring box 4.

The cover 7 is constituted by a plurality of dividing elements 17 which can be disassembled as shown in FIGS. 10 to 13.

In the preferred embodiment, two dividing elements (they are described as a first divided element 17*a* and a second divided element 17*b* in the latter description) are used.

As shown in FIG. 10, the first dividing element 17*a* is made such that each of the side opposing against the second dividing element 17*b* and a lower side is released, the upper plate 17*a*-1 is a substantial half divided box extended to the second dividing element 17*b*, and a fixing flange 17*a*-3 bent and formed at the lower end of a circumferential plate 17*a*-2 is removably attached to the top plate 11 of the case with a screw 100.

In addition, the first dividing element 17*a* is provided with a connecting port 17*a*-4 for use in fixing the lower end of the outer cord supporting member Y at its upper plate 17*a*-1, and a pair of inserting holes 17*a*-5 and 17*a*-5 are opened with the connecting port 17*a*-4 being held therebetween.

As shown in FIG. 10, the second dividing element 17*b* is made such that each of the side opposing against the first dividing element 17*a* and a lower side is released, the lower end of the circumferential plate 17*b*-2 is provided with protruding hook pieces 17*b*-4, 17*b*-4 showing a substantial larger half-box shape than that of first dividing element 17*a* having the fixing flange 17*b*-3 bent and formed in the same manner as that of the first dividing element 17*a* and removably engaged from above with inserting holes 17*a*-5, 17*a*-5 from the extremity end of the upper plate 17*b*-1, and when the hook pieces 17*b*-4, 17*b*-4 are engaged with inserting holes 17*a*-5, 17*a*-5, a recess 17*b*-5 for use in avoiding its striking against the supporting element Y for the outer cord is recessed and formed at the upper plate 17*b*-1 and then the fixing flange 17*b*-3 is removably attached to the top plate 11 of the case with a screw 100 in the same manner as that of the first dividing element 17*a*.

In FIGS. 1 to 3 and FIGS. 6 to 10, reference numeral 10 denotes a temporary fixing mechanism for a unit member A1. This temporary fixing mechanism 10 is constituted by insertion holes 10*a* opened at a pair of opposing side plates 41, 41 of lower level of the partition plate 5 at the case 1, and an inverse L-shaped piece 10*b* inserted into the insertion hole 10*a* in such a manner that it may be turned half.

This inverse L-shaped piece 10*b* is made such that a plurality of spaced-apart horizontal sections 10*b*-2 are extended at a right angle in respect to a vertical section 10*b*-1 composed of a slight shorter belt plate than that of a pair of opposing side plates 41, 41 at the case 1 and an engaging protrusion 10*b*-3 engaged with a hole edge of the insertion hole 10*a* from outside is cut and raised at the horizontal section 10*b*-2.

Due to this fact, the horizontal section 10*b*-2 becomes lighter as compared with that of the vertical section 10*b*-1 and normally an engaging protrusion 10*b*-3 cut, raised and formed under a state in which the horizontal section 10*b*-2 is inserted from the insertion hole 10*a* toward an outer side is engaged with a hole edge of the insertion hole 10*a*.

As shown in FIGS. 2 and 3, the front panel 6 is fixed with screws 100 to a bracket 31*a* arranged at an outward flange 31 of the lower end of the case 1 so as to shield the partition plate 5 from below under a state in which a grease filter 16 which can be fixed or removed in response to the bell mouth 35 of the case 1 having the partition plate 5 fixed thereto is installed, a light shielding plate 26 which can be opened or closed in response to the lamp box 9 is mounted, an operating part T is set on a portion other than the foregoing, and a dividing plate 36 engageable or unengageable from below is engaged with the partition plate 5 so as to divide between one half side having the bell mouth 35 and the other half side having the lamp box 9.

The operating part T is integrally provided with an electrical wiring box T2 such as the aforesaid control section or the like at the rear side of the operating panel T1 having ON/OFF switch for the multi-vane fan, a rotating speed adjustment switch and ON/OFF switch for a lamp and the like.

The gas discharging duct coupler 8 is provided with an electric shutter 18 and it is arranged such that surrounding air is prevented by the electrical shutter 18 from being flowed in the fan when the fan is not used.

As shown in FIGS. 14 to 16, this electric shutter 18 is constructed such that a shutter plate 18*a* having a substantial same area as that of an inner space of the gas discharging duct coupler 8 is rotatably fitted to the coupler 3, its rotating shaft 18*b* drives a motor 18*c*, an arm 18*d* is fixed to the end part of the rotating shaft 18*b* outside the gas discharging duct coupler 8 around the end part of the shaft, one end of the arm

18*d* is connected to a free end of a tension spring 18*e,* a limit switch 18*f* is arranged in correspondence with the other end, upon touching the multi-vane fan driving switch, the motor 18*c* is driven and the shutter plate 18*a* is rotated by 90°, the fan motor 2 is driven only after the other end of the arm 18*d* turns ON a limit switch 18*f,* and further upon touching the multi-vane fan driving terminating switch, the arm 18*d* is moved away from a limit switch 18*f* upon receiving a tension force of the tension spring 18*e* and turned OFF to cause the fan motor 2 to be stopped, and substantially in concurrent with this state, the shutter plate 18*a* is rotated by 90° in a reverse direction to close the space in the gas discharging duct coupler 8. Reference numeral 18*g* denotes stoppers for restricting a rotating direction of the shutter plate 18*a,* the stoppers are oppositely projected from the inner circumferential surface of the gas discharging duct coupler 8 into an inner side, one of them corresponds to the upper surface of the shutter plate 18*a* and the other corresponds to the lower surface of the shutter plate 18*a*.

It is of course apparent that the motor 18*c,* arm 18*d*, and the tension spring 18*e* and the like are covered by a box 18*h* fixed to the gas discharging duct coupler 8.

As shown in FIGS. 10 and 12, the supporting member Y for external cords is a conduit for the external cord W1 or the like (a power supply cord or an earth cord and the like) suspended from a building or an integral linear member in which the external cords W1 are coated with an insulating film, its lower end location is formed with a threaded cylinder (y) having a flange, the threaded cylinder (y) is inserted into a connecting port 17*a*-4 of the first divided member 17*a*, thereafter it is fixed with a nut 200 against the first divided member 17*a* in such a way that the edge of the connecting port 17*a*-4 is held with a flange (y') from the inner space.

The blower unit A constructed as above is packaged and shipped under a state in which the inner cords W or the like are taken out of the taking-out port 21 of the top plate 11 of the case, the cover 7 comprised the first dividing member 17*a* and the second dividing member 17*b* is temporarily fixed to the top plate 11 of the case in such a way that the terminal (connector) W' may be stored in the storing space 7*a*, the inverse L-shaped piece 10*b* is set, the partition plate 5 is fixed and the front panel 6 is temporarily fixed.

Then, the package is unpacked at an assembling and installing site, the front panel 6 is removed, and the unit member A1 provided with the multi-vane fan 12, fan motor 2, electrical wiring box 4, lamp box 9 and partition plate 5 or the like is freely fitted from below into the fixing port B2 of the hood B laterally installed between wall cabinets 300, 300 as shown in FIG. 7.

Then, as shown in FIGS. 8(*a*) and (*b*), the horizontal section 10*b*-2 of the inverse L-shaped piece 10*b* strikes against an edge part of the fixing port B2, it is turned half automatically in a downward direction and the unit member A1 is freely fitted to the fixing port B2 while the horizontal section 10*b*-2 is not applied as a hindrance. After free fitting of it, the horizontal section 10*b*-2 returns back to its horizontal state under a balance of weight with the vertical section 10*b*-1. When a force for lifting up the unit member A1 is loosened as shown in FIG. 8(*c*), the horizontal section 10*b*-2 is mounted on an upper surface of the top plate B1 of the hood B and then the unit member A1 is automatically and temporarily fixed.

The engaging protrusion 10*b*-3 is required to stabilize the inverse L-shaped piece 10*b* more and its arrangement is optional.

Assembling of the unit member A1 against the hood B is carried out such that an outward flange 31 of the unit member A1 is slightly lifted up manually in such a manner that it may be abutted against the inner surface of the hood top plate B1 of the edge of the fixing port B2, a rectangular plate P having a hole P1 is mounted at the upper surface position of the hood top plate B1 avoiding the horizontal section 10*b*-2, and a screw 100 passing through a fixing hole 31*b* opened at the outer flange 31 and a through hole 31*b* opened at the hood top plate B1 is fixed to the hole P1 of the rectangular plate P through tapping (FIGS. 8(*d*) and 9)).

A free rotation of the rectangular plate P during this tapping operation is prevented by the outer surface of the case 1 (see FIG. 9).

Then, under a state in which the dividing plate 36 for dividing a lower space of the partition plate 5 into one half side having the bell mouth 35 and the other side having the lamp box 9 is placed at an intermediate part, the front panel 6 is fixed from below with a screw 100 against the bracket 31*a* arranged at the outward flange 31 of the case 1.

It is of course apparent that a wire connection between the cord of the control section and the inner cord or the like is carried out at a pre-stage in which the front panel 6 is fixed.

A connecting operation for the external cord w1 is carried out such that the second dividing member 17*b* of the cover 7 temporarily fixed at the time of packaging as described above is removed from the first dividing member 17*a*, the threaded cylinder (y) at the lower end of the supporting member Y for the external cord is passed through the connecting port 17*a*-4 of the first dividing member 17*a,* it is fixed with a nut 200 while the inner space 17*a*' is being applied as a working space and then the terminal W1' of the external cord W1 and the terminal W' of the inner cord W are connected under utilization of the inner space 17*a'*.

This connecting operation can be carried out not only in the inner space 17*a*' of the first dividing member 17*a* but also carried out while it is being drawn out into an open space.

After connecting operation, the hook pieces 17*b*-4, 17*b*-4 of the second dividing member 17*b* are inserted into and removably engaged with the insertion holes 17*a*-5, 17*a*-5 of the first dividing member 17*a* so as to cover the connected portion and further again they are removably fitted to the top plate B1 of the hood B with a screw 100. With such an arrangement as above, the connected portion is stored in the storing space 7*a* of the cover 7 and protected against the external area.

Lastly, the front panel 400 of the canopy is fixed to the front surface of the hood B, the gas discharging duct D is connected to the gas discharging duct coupler 8 to complete the assembling work.

Maintenance of the connected portion can be easily carried out by removing the front panel 400 of the canopy and further by removing the second dividing member 17*b*.

Reference numeral 10*b*-4 denotes an operating protrusion piece extended from the vertical section 10*b*-1 at the inverse L-shaped piece 10*b*.

In the case that the blower unit A is removed from the hood B due to the whole repairing work or the like, this removing operation is performed after the connected state with the gas discharging duct D and the connected state between the external cord W1 and the inner cord W are released in the upper space of the top plate B1 of the hood B, the front panel 6 is removed, the fixing of the case 1 with the hood B is released to have the temporary fixed state. The operating protrusion piece 10*b*-4 is effectively utilized as a finger hook when the horizontal section 10*b*-2 is turned half in a vertical direction so as not to strike against and hinder the edge of the fixing port B2 in the case that the unit member A1 under its temporary fixed state is to be descended. It is also apparent that the descending operation of the unit member A1 described above is carried out after the unit member A1 is slightly lifted up and the horizontal section 10*b*-2 is turned half in a vertical direction.

Effects of the Invention

Since the present invention has been constituted as described above, the following advantages can be attained.

In reference to Claim 1, the inner cord or the like are taken out of the top plate of the case in the unit member storing a multi-vane fan and a fan motor or the like to the external area, a holder for the external cords or the like vertically suspended from a ceiling of a building is fixed in communication with a required divided member of cover comprised of a plurality of decomposable divided members, the external cords (a power supply cord and the like) held at the holder and the inner cords taken out are bundled (connected), the other divided member is fixed to the divided member to cover the connected portion in such a way that the connected portion may be stored in the storing space, so that after completion of assembling and installing of the unit member to the hoods, the external cords (a power supply cord and the like) and the inner cords can be connected to each other under a utilization of an open space above the unit member, a connecting work can be performed quite easily and the connected portion can be protected against the external area.

In addition, this invention does not show any illegal matter against the provision of UL Standards, the desired divided member is removed to cause the connected portion to be open, resulting in that no tension force is applied to the connected portion and a repair and maintenance management of the connected portion can be carried out without any trouble.

In reference to Claim 2, the unit member is constructed such that the volute plate is assembled around the multi-vane fan, the partition plate having a suction port in correspondence with the multi-vane fan is fixed from the lower releasing section of the main body case in an inner fitted state to enclose or form a fan casing, and although the multi-vane fan having a superior discharging efficiency is used, it is possible to prevent a heavy weight or a large-sized device of a type in which the fan casing is separately stored in it, its assembling work can be improved and the device is compact in size.

In reference to Claim 3, in the case that the blower unit is fixed to the hood, the horizontal section of the inverse L-shaped piece capable of being turned half inserted into a pair of opposing side plates of the case is turned in a vertical direction so as not to become an obstacle when it is freely fitted to the fixing port of the hood, the horizontal section is turned half in a reverse direction when the horizontal section reaches the rear side of the hood, a temporary fixing of the unit member can be carried out with a simple operation of only the half turn of the inverse L-shaped piece where the horizontal section is mounted on the upper surface of the top plate of the hood at the edge of the fixing port and then the assembling work can be completed with fixing of the unit member to the hood and fixing of the front panel from lower side. Accordingly, the post-operation work (such as fixing to the hood and fixing of a front panel or the like) can be performed after the heavy unit member including the multi-vane fan and the fan motor or the like is once temporarily fixed, a large-scaled work in which a working role must be born by a worker supporting the heavy unit member and another worker present near the former worker to fix it to the hood with screws can be eliminated and then an assembling work for the blower unit is made easy.

In reference to Claim 4, in the case that the inverse L-shaped piece is made such that the horizontal section is made light in its weight in respect to the vertical section, the horizontal section of the inverse L-shaped piece when the unit member is freely fitted to the hood fixing port is turned half at the edge of the fixing port in a vertical direction not to produce any obstacle against the free fitting, and after free fitting, it is automatically turned half in a reverse direction and it is returned to a state in which its temporary fixing can be carried out, resulting in that a poor workability for artificially operating the inverse L-shaped piece can be eliminated and a series of assembling works of the blower unit including the fixing of the front panel can be carried out quite easily.

Having described specific examples of the invention with reference to the accompanying drawings, it will be appreciated that the present invention is not limited to those precise embodiments, and that various changes and modifications can be effected therein by one of ordinary skill in the art without departing from the scope of the invention as defined by the appended claims.

What is claimed is:

1. A blower unit for a range hood which is attachable to an exhaust port located at said hood, said blower unit comprising a casing defining a chamber having a gas-discharging multi-vane fan and a fan motor stored therein, said casing including a top plate adapted to communicate with said exhaust port, said top plate having an upper surface outside said chamber, said casing further includes opposed side plates communicating with said top plate, said top plate and said side plates cooperating to define said casing chamber, and an inverse L-shaped piece is inserted into each of side plates of said casing whereby a horizontal section of said L-shaped piece is protruded outwardly in such a manner that it can be turned half, said horizontal section is turned half outside in a vertical direction when the unit member is freely fitted to said fixing port from below so as not to prohibit its free fitting, after the free fitting, it is turned half in an inverse direction and the horizontal section is mounted on the upper surface of said hood, said fan including electrical wiring comprising inner and outer cords, wherein said inner cords are taken out externally of an exit port defined in said top plate and said casing has a volute plate assembled around the multi-vane van, and a partition plate having a suction port in correspondence with the multi-vane van, said partition plate attached to a lower releasing section of said casing and cooperates with said casing to enclose said fan.

2. A blower unit for a range hood according to claim 1, wherein said inverse L-shaped piece comprises said horizontal section and a vertical section, and said horizontal section has a lighter weight than said vertical section.

* * * * *